United States Patent [19]

Eheim

[11] 4,083,346

[45] Apr. 11, 1978

[54] FUEL INJECTION PUMP FOR INTERNAL COMBUSTION ENGINES

[75] Inventor: Franz Eheim, Stuttgart, Germany

[73] Assignee: Robert Bosch GmbH, Stuttgart, Germany

[21] Appl. No.: 652,869

[22] Filed: Jan. 27, 1976

[30] Foreign Application Priority Data

Jan. 28, 1975 Germany ..... 2503355

[51] Int. Cl.[2] ..... F02M 59/42

[52] U.S. Cl. .....123/139 BD; 417/440; 417/441; 417/456; 417/505

[58] Field of Search ..... 123/139 BD, 139 E, 139 AZ, 123/139 DP, 139 AA, 198 DB; 417/440, 441, 456, 505; 251/129, 141

[56] References Cited

U.S. PATENT DOCUMENTS

| | | | |
|---|---|---|---|
| 1,175,864 | 3/1916 | Gold | 251/129 |
| 2,404,514 | 7/1946 | McClure | 251/129 X |
| 2,826,215 | 3/1958 | Wolfslau et al. | 251/129 X |
| 2,980,139 | 4/1961 | Lynn | 251/129 X |
| 3,598,507 | 8/1971 | Voit et al. | 417/505 |
| 3,661,130 | 5/1972 | Eheim | 123/140 A |
| 3,797,235 | 3/1974 | Eheim | 123/139 AW X |
| 3,805,203 | 4/1974 | Deckard | 251/129 X |
| 3,842,809 | 10/1974 | King | 123/139 E X |
| 3,906,916 | 9/1975 | Laufer | 123/139 AP |

*Primary Examiner*—Charles J. Myhre
*Assistant Examiner*—Tony M. Argenbright
*Attorney, Agent, or Firm*—Edwin E. Greigg

[57] ABSTRACT

A fuel injection valve for an internal combustion engine includes a fuel storage compartment and a pressure chamber from which a reciprocating pump piston delivers fuel to the engine's fuel lines. The fuel conduit between the storage compartment and the pressure chamber can be closed off by an electromagnetic valve. To permit engine operation even when the electrical system is non-functional, the magnetic valve is of the normally open type, held open by a spring. In the energized state, the valve closes off the fuel conduit and its closure is aided by the fuel pressure gradient across the valve.

10 Claims, 2 Drawing Figures

FUEL INJECTION PUMP FOR INTERNAL COMBUSTION ENGINES

BACKGROUND OF THE INVENTION

The invention relates to fuel injection pump for internal combustion engines including a pump pressure chamber and a fuel storage compartment held at relatively low pressure and a fuel supply or suction conduit through which the pump aspirates fuel from the storage compartment to the pressure chamber in normal operation. An electromagnetic valve is provided to obturate the fuel suction conduit in order to arrest the engine.

In known fuel injection pumps of the general type described above, restarting the internal combustion engine is impossible after the electrical system has been turned off since the magnetic valve obturates the suction conduit.

This factor can be very undesirable when the engine is installed in water-borne vehicles or in land vehicles in which long uninhabited stretches of road must be traversed.

OBJECT AND SUMMARY OF THE INVENTION

It is a principal object of the invention to provide a fuel injection pump which does not suffer from the above-mentioned disadvantage of inability to restart the engine, while including fuel control by electromagnetic valving.

This object is attained, according to the invention, by providing a normally-open electromagnetic valve permitting fuel to flow from the fuel suction compartment into the pump pressure chamber. When the magnetic armature is actuated against the force of the valve spring, it is aided by the pressure difference existing between the fuel suction compartment and the pump pressure chamber.

The invention will be better understood as well as further objects and advantages become more apparent from the following detailed description of a preferred embodiment taken in conjunction with the drawing.

DESCRIPTION OF THE PREFERRED EMBODIMENT

Figure 1:
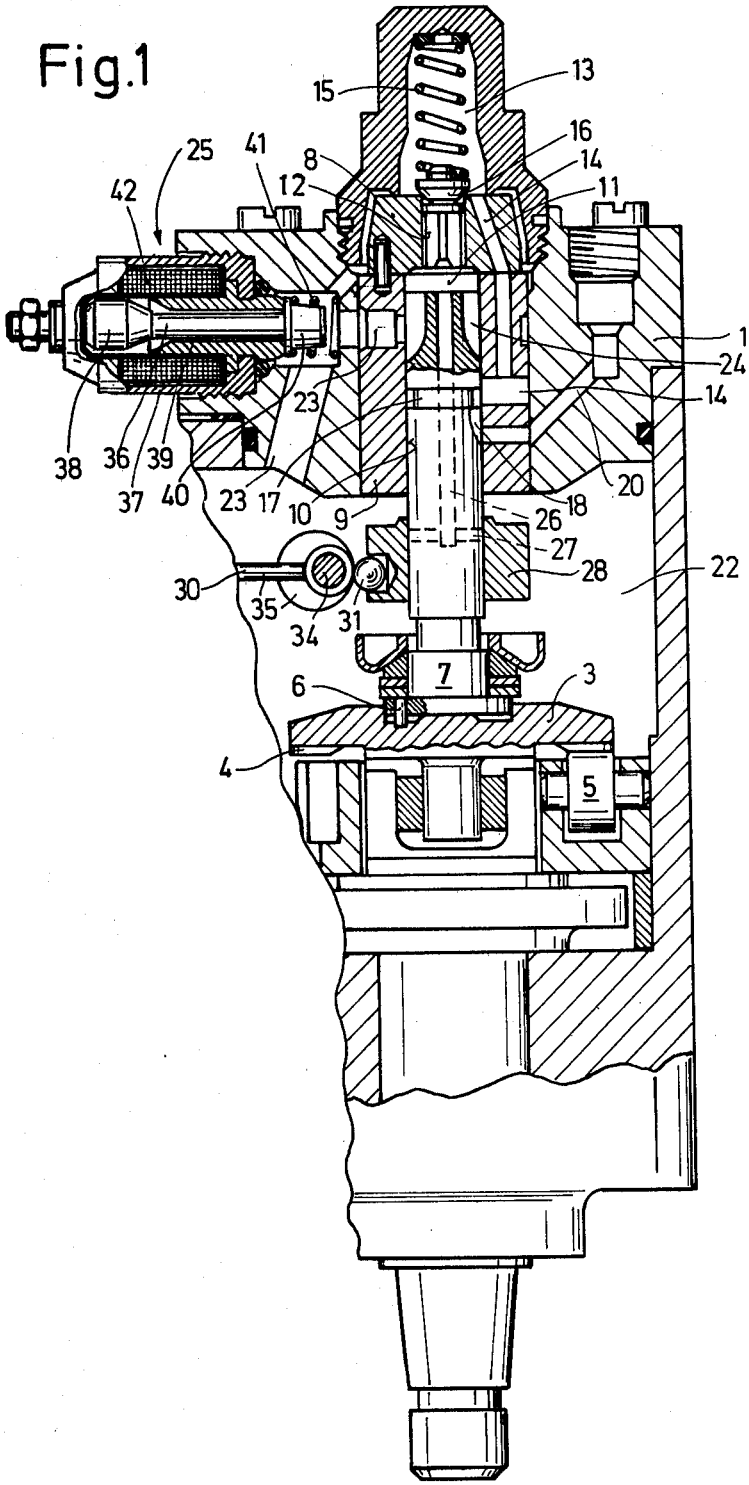
FIG. 1 is a partial longitudinal section through a distribution injection pump according to the invention.

Turning now to FIG. 1, there is shown a fuel injection pump for multi-cylinder, internal combustion engines including a housing 1 in which is rotatably carried a drive shaft 2. Co-rotating with drive shaft 2 is a frontal cam plate 3 provided with a plurality of cam lobes 4 which cooperate with locally-fixed rollers 5. The rotation of the drive shaft 2, due to means not shown, causes rotation of the frontal cam plate 3 which is transmitted by a coupling member 6 to a pump piston 7 which is thereby made to undergo simultaneous reciprocating and rotating motion while being pressed on the cam plate 3 by spring means not shown. The number of cam lobes 4 and hence the number of piston strokes per revolution is equal to the number of cylinders in the engine.

The piston 7 moves in a bore 10 within a cylindrical bushing 9, closed on top by a valve carrier 8, thereby defining a working pressure chamber 11. An axial bore 12 in the valve carrier 8 connects the pressure chamber 11 with a blind chamber 13 which is connected by a line 14 to the cylindrical bore 10 in the bushing 9. The axial bore 12 may be obturated by a valve member 16 loaded by a spring 15. The connecting line 14 terminates radially into the cylindrical bore 10, and an annular groove 17 located on the circumference of the pump piston and a longitudinal groove 18 connected thereto create a communication between the terminus of the connecting line 14 and sequential ones of the individual pressure lines 20 during each compression stroke of the piston. The pressure lines 20 lead to individual engine cylinders (not shown) and are equal in number to the number of engine cylinders.

During each compression stroke of the piston 7, fuel is delivered through the axial bore 12, which opens the valve member 16, and hence into the chamber 13, the connecting line 14 and through the distribution groove 18 to one of the pressure supply lines 20. During the downward, suction stroke of the piston, fuel flows from a slightly pressurized pump suction chamber 22 through a suction line 23 into the bore 10. The fuel flow from the suction chamber is controlled by a number of longitudinal grooves 24 on the pump piston, equal in number to the number of pressure lines 20. During the compression stroke of the piston, the rotation of the piston interrupts the communication between the suction line 23 and the longitudinal grooves 24 so that the entire fuel quantity supplied by the piston is delivered to one of the pressure lines 20. The suction conduit 23 is further controllable by an electromagnetic valve 25, as will be explained in detail below.

The amount of fuel delivered to the engine is controlled by changing the fuel flow from the pressure chamber 11 to the suction chamber 22 through a blind bore 26 in the pump piston 7 which connects with a transverse bore 27. Cooperating with the transverse bore 27 is a fuel quantity setting member 28, embodied as an annular slide displaceable on the outside surface of the pump piston, whose position determines the point of time at which the transverse bore 27 is opened when the pump piston moves upwardly, thus creating a communication between the pressure chamber 11 and the pump suction chamber 22. From this point on, the supply of fuel to the pressure line 20 is interrupted. By changing the position of the annular slide 28, the fuel quantity actually delivered to the engine may thus be adjusted.

The adjustment of the fuel quantity is performed by the engagement of a ball head 31 of a control lever 30 engaging a recess 32 in the annular slide 28. The control lever pivots about a point 34 whose position can be changed by an eccentric 35. The other end of the control lever 30 is engaged by a control spring in opposition to the force of an r.p.m. signal generator. The bias tension of the control spring may be adjusted with an arbitrarily settable lever. When the engine r.p.m. increases, the r.p.m. signal generator acts to reduce the injected fuel quantity, whereas the spring urges the lever in the direction of increasing fuel quantity. The equlibrium position, which defines the actual injected fuel quantity, can be adjusted by the above-mentioned lever.

The magnetic valve 25 has a casing 37 on which are provided external screw threads which engage complementary threads in the fuel pump housing 1. An armature 38 is connected by a rod 36 with a movable valve member 40. A spring 41 loads the valve member 40 so as to maintain the valve in the open condition when deenergized. Mutually opposite end faces of the armature 38 and a core 39, respectively, are conical, to provide favorable magnetic flux conditions when the coil 42 is energized. Energizing the magnetic coil 42 obturates the suction conduit 23 and thus stops the engine. When the electrical system of the internal combustion engine is turned off, the magnetic valve 25 re-opens so that, during restart or during a possible failure of the electrical system, fuel can again be supplied from the suction compartment 22 to the pump pressure chamber 11.

Figure 2:
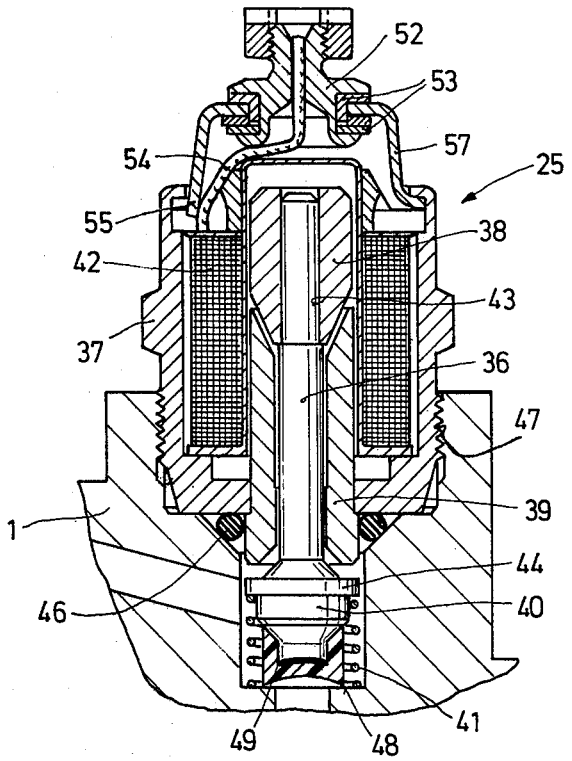
FIG. 2 is an enlarged illustration of the construction of the magnetic valve in FIG. 1.

In a particularly favorable feature of the invention, shown in FIG. 2, the non-magnetic rod 36 is connected to the armature 38 made of magnetic material in a press-fit, while being inserted in a bore 43. Furthermore, the movable valve member 40 has a flange 44 which supports the spring 41 and also serves as a stroke-limiting stop by cooperating with the end of the core 39 which faces it. At the end nearest the valve seat, the magnet core 39 extends through the casing 37 and serves as support for a sealing ring 46 disposed between the core 39 and an interior surface of the pump housing 1. The magnetic valve 25 may be threadedly disengaged from the housing 1 and the threaded opening 47 may be obturated by a threaded plug in the event that the control of fuel flow through suction conduit 23 is not required. The end 48 of the movable valve member 40 is provided with an elastic sealing material 49, preferably of rubber-like consistency, and preferably vulcanized directly onto the armature tip 40.

On the side remote from the valve seat, the magnetic valve casing 37 is enclosed by a cover 57 which has a central aperture carrying an electric contact screw 52 which is insulated by plastic rings 53 with respect to the cover 57 and the casing 37. An electrical connector 54 leads from the contact screw 52 to the magnetic coil 42. The cover has a projection 55 which engages the coil body to prevent a relative rotation of the coil 42 and the contact screw 52 or the cover 57, which might result in fracture of the conductor 54. The edge of the casing 37 is clamped or crimped around the adjacent edge of the cover 57, thereby fastening it permanently.

What is claimed is:

1. In a fuel injection pump for internal combustion engines which includes a housing, a fuel storage compartment in said housing, cylinder means disposed in said housing and a reciprocating and rotating piston moving in said cylinder means and defining a pressure chamber, a plurality of fuel channels in said housing, one terminus of each of said plurality of fuel channels lying in the wall of said cylinder, said piston having radial apertures which cooperate with said termini to thereby provide rpm-dependent flow control through said plurality of fuel channels, a suction conduit connected between said mutually communicating fuel channels and said fuel storage compartment, the improvement comprising an electromagnetic valve associated with said housing for controlling fuel flow through said suction conduit, said valve further including a casing, a magnet core disposed in said casing, an armature arranged to cooperate with said core, a valve closure means associated with said armature and said valve closure means being opened to permit passage of fuel through said suction conduit upon de-energization of said electromagnetic valve.

2. A fuel injection pump as defined by claim 1, wherein said housing includes valve seat means and a resilient means is disposed between said valve seat means and said valve closure means.

3. A fuel injection pump as defined by claim 1, wherein said valve closure means is affixed to said armature by a rod member.

4. A fuel injection pump as defined by claim 3, wherein said rod member and said valve closure means are made from non-magnetic material.

5. A fuel injection pump as defined by claim 1, wherein the valve closure means includes a flange portion that is arranged to cooperate with said magnet core to limit axial movement of said valve closure means.

6. A fuel injection pump as defined by claim 5, wherein said flange portion forms a seat for one surface of a spring element, said spring having its other surface received on said valve seat means.

7. A fuel injection pump as defined by claim 1, wherein said electromagnetic valve is threadedly engaged in said housing further includes a terminal wall, said magnet core extending beyond said terminal wall and sealing means arranged to encompass said magnet core.

8. A fuel injection pump as defined by claim 1, the improvement further comprising a perforated concentric cover crimped on said valve casing and provided with an inward projection which engages stationary portions of said valve, thereby preventing relative rotation of said cover and said valve and further provided with electrical connector means for carrying electric current to the magnetic coil of said electromagnetic valve.

9. A fuel injection pump as defined by claim 8, wherein said electrical connector means is a central screw and nut assembly disposed in said perforated cover and insulated electrically from said cover by an insulating ring.

10. A fuel injection pump as defined by claim 1, wherein said valve closure means is provided with an elastic coating for providing fluid sealing with a valve seat.

* * * * *